US005289872A

United States Patent [19]

Kent

[11] Patent Number: 5,289,872

[45] Date of Patent: Mar. 1, 1994

[54] SACRIFICIAL BRACKETS FOR ALUMINUM HEAT EXCHANGER

[75] Inventor: Scott E. Kent, Albion, N.Y.

[73] Assignee: General Motors Corporation, Detroit, Mich.

[21] Appl. No.: 64,474

[22] Filed: May 21, 1993

[51] Int. Cl.[5] ..... F28F 19/02

[52] U.S. Cl. ..... 165/133; 165/134.1; 165/149; 29/890.03

[58] Field of Search ..... 165/1, 133, 134.1, 149; 29/890.03

[56] References Cited

U.S. PATENT DOCUMENTS

| | | | |
|---|---|---|---|
| 3,310,489 | 3/1967 | Davis | 252/32.5 |
| 4,207,942 | 6/1980 | Cowan et al. | 165/133 X |
| 4,209,059 | 6/1980 | Anthony et al. | 165/134.1 X |
| 4,473,110 | 9/1984 | Zawierucha | 165/133 |
| 4,647,436 | 3/1987 | Herbort et al. | 165/134.1 X |
| 4,655,977 | 4/1987 | Komiya et al. | 165/134.1 X |
| 4,738,307 | 4/1988 | Bentley | 165/134.1 X |
| 4,776,392 | 10/1988 | Loyd | 165/134.1 |
| 4,892,141 | 1/1990 | Shiga et al. | 165/134.1 X |
| 4,901,791 | 2/1990 | Kadle | 165/150 |
| 5,054,549 | 10/1991 | Nakaguro | 165/134.1 X |

*Primary Examiner*—John Rivell
*Attorney, Agent, or Firm*—Patrick M. Griffin

[57] ABSTRACT

A heat exchanger of the type for directing air across a core thereof for heat transfer with fluid flowing within the core includes a pair of tubes connected in parallel between an inlet and an outlet. The tubes form a plurality of passes across the face of the heat exchanger with tube bends at the ends of each pass defining a serpentine path. A header channel extends over the bends of the passes. The header channel includes a zinc alloy coating on the interior surface thereof in contact with the bends. The zinc alloy coating provides sacrificial corrosion that prevents corrosion of the bends.

5 Claims, 2 Drawing Sheets

SACRIFICIAL BRACKETS FOR ALUMINUM HEAT EXCHANGER

TECHNICAL FIELD

The invention relates to a heat exchanger of the serpentine tube type, and more particularly to the materials for supporting and mounting the exchanger.

BACKGROUND OF THE INVENTION

Heat exchangers have been used in vehicles as either radiators or condensers. Such heat exchangers may be of the serpentine flow tube type. Representative of this type of heat exchanger is the condenser disclosed in U.S. Pat. No. 4,901,791 issued Feb. 20, 1990 in the name of Kadle, and assigned to the assignee of the subject invention. The patent discloses a serpentine condenser having unequal flow paths communicating between an inlet and an outlet. The heat exchanger includes a header channel forming a mounting bracket for supporting the flow tubes and for allowing mounting of the condenser in the vehicle.

During testing of long life alloys for serpentine tube and center condensers, it has been determined that the cores almost always fail on a tube bend. In the tube bend area there are no centers contacting the tube. In the core face, the zinc within the air centers helps protect the tubes by sacrificially corroding itself over a broad, but shallow area thereby preventing deep pits through the tube. Currently, brackets or header channels are fitted over the ends of the core in the area of the tube bends to mimic the mounting arrangement for a headered tube and fin style condenser. A layer of protective zinc may be placed on the steel by hot dip galvanizing. Currently, the header channels are then painted on both sides with epoxy paint. However, the paint acts as a barrier to the zinc.

The benefit of using corrosion resistant materials in a radiator is disclosed in U.S. Pat. No. 4,209,059 issued Jun. 24, 1980 Anthony et al and U.S. Pat. No. 4,473,110 issued Sep. 25, 1984 in the name of Zawierucha. The '059 patent discloses a corrosion resistant material between the header and tank, and the Zawierucha patent discloses a corrosion resistant header in a plate and fin type heat exchanger.

SUMMARY OF THE INVENTION

The invention is a heat exchanger apparatus of the type for directing fluid through a core thereof for heat transfer with air flowing across the core. The apparatus includes an inlet and an outlet. A tube flow passage follows a serpentine path having a plurality of straight passes across the core with bends at the ends of each pass and lying in a single plane connecting the inlet to the outlet for communication of the fluid therebetween. A header channel extends over and contacts the tube bends for supporting the sides of the serpentine tube. The header channel comprises an interior surface coated with a layer of sacrificial corrosion material for allowing corrosion thereof while preventing corrosion of the bend. More specifically, the interior surface is coated with a zinc alloy.

BRIEF DESCRIPTION OF THE DRAWINGS

The advantages of the invention will become more readily apparent when taken in conjunction with the accompanying drawings wherein.

DESCRIPTION OF THE PREFERRED EMBODIMENT

Figure 1:
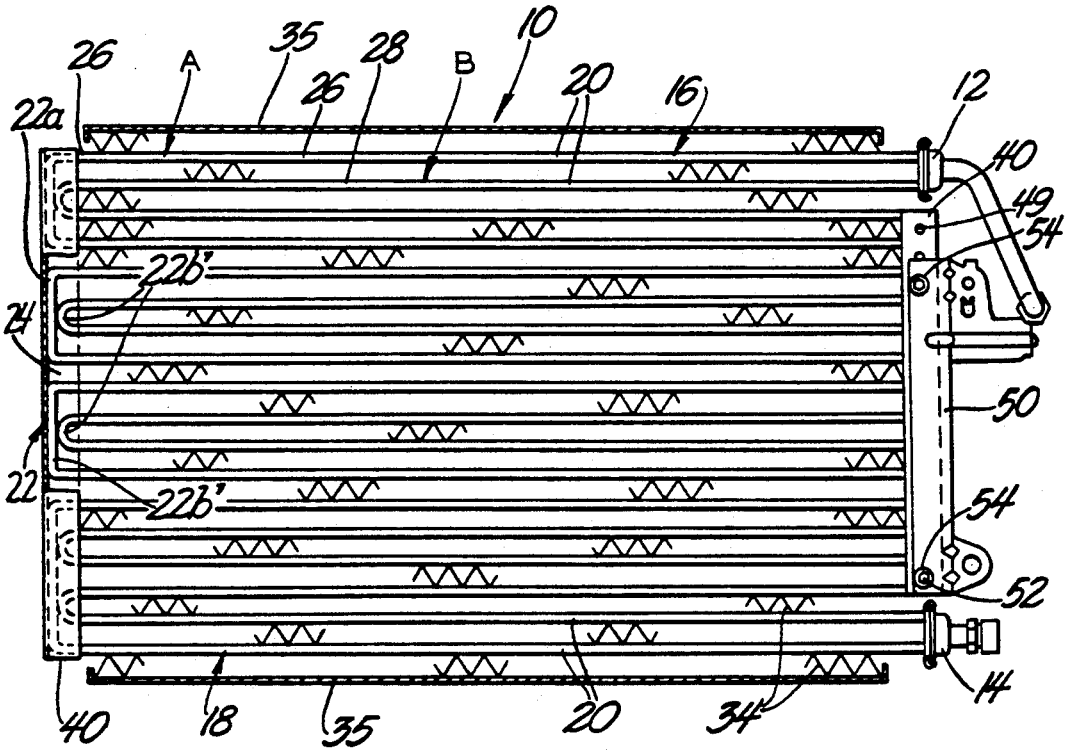
FIG. 1 is a partially broken away front elevational view of the heat exchanger of the subject invention.

A heat exchanger of the subject invention is generally shown at 10 in FIG. 1. The heat exchanger circulates a fluid or heat exchange medium for heat transfer with air passing thereacross. In the preferred embodiment, the heat exchanger 10 is a condenser containing refrigerant for use in vehicles. However, it is to be understood that the heat exchanger 10 may be utilized as other types of exchangers in various other applications.

The heat exchanger 10 includes an inlet port 12 for receiving the refrigerant, and an outlet port 14 for directing refrigerant from the heat exchanger 10. The inlet port 12 and outlet port 14 extend from the same side of the heat exchanger 10.

A flow passage 16 following a serpentine path is connected between the inlet port 12 and the outlet port 14. The flow passage 16 has a plurality of straight passes 20 extending across the core 18 and connected by U-shaped bends 22 at the ends 24 of each pass 20. The passes 20 lie in a single plane with the bends 22 aligned with one another.

Figure 3:
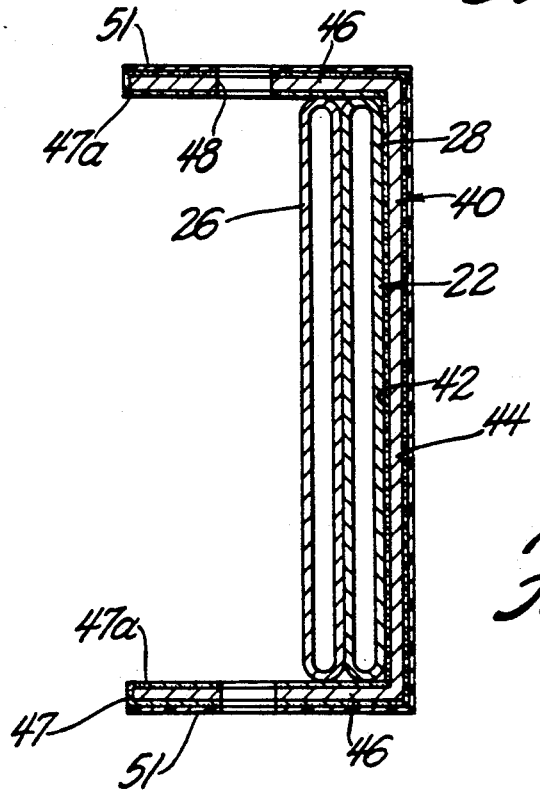
FIG. 3 is an enlarged cross sectional view taken along lines 3—3 of FIG. 2 looking in the direction of the arrows.
Figure 2:
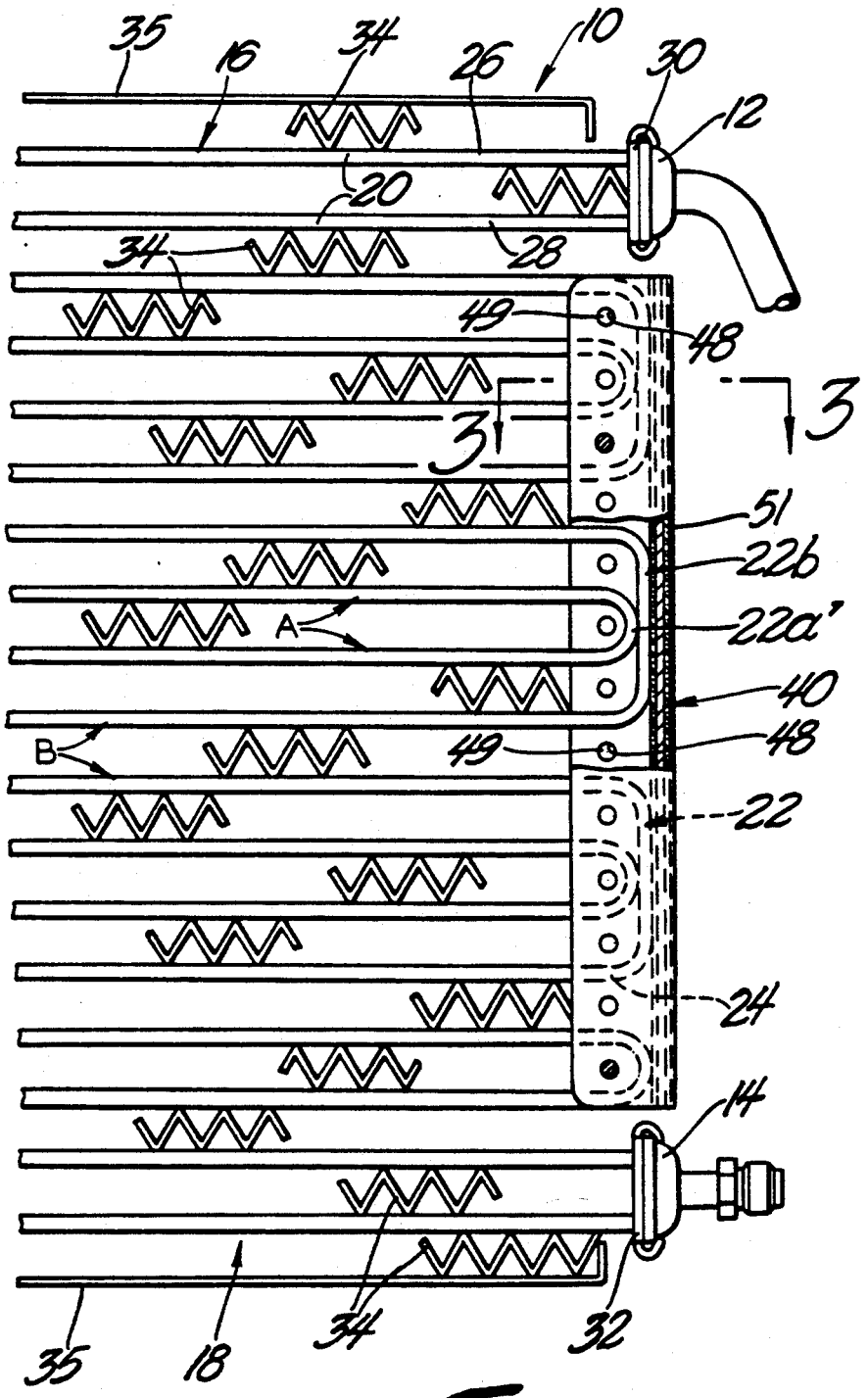
FIG. 2 is a partially broken away enlarged front elevational view of the heat exchanger of FIG. 1.

In the preferred embodiment, the flow passages 16 are comprised of two parallel tubes 26, 28 connected between the inlet port 12 and outlet port 14. The inlet port 12 is coupled by connector 30 to the parallel tubes 26, 28. The tubes 26 form a passage A and the tubes 28 form a passage B through the several loops of the condenser core 18 and terminate at another connector 32 that connects to the outlet port 14. The tubes 26, 28 are comprised of flattened tubes with maximized surface area as illustrated in FIG. 3.

There are eight tube passes 26 in passage A, and ten tube passes 28 in passage B. Starting from the inlet port 12, the passages A and B are arranged side by side and bend together through several loops. An extra outlet loop is provided in passage B at outlet port 14. On the left side of the core 18 as viewed in FIG. 1, the passage A includes external bends **22*a*. Bends 22*b'* of passage B are formed inside and contacting the bends 22*a* of the passage A. The right side of the core 18 includes external bends 22*b* in the passage B with the bends 22*a;* of passage A formed adjacent and contacting the bends 22*b*** of passage B.

Air centers 34 or fins are sandwiched between adjacent tubes 26, 28 and between the outer tubes to reinforce plates 35. The air centers 34 are comprised of sinusoidally shaped sheet metal connected to the tubes 26, 28 as commonly known in the art. The air centers 34 are aluminum fins coated with a braze coating with zinc alloy. The zinc alloy serves as a sacrificial corrosion material that protects the tubes.

A header channel 40 extends over and contacts the exterior tube bends 22 at the ends 24 of the passes 20 for supporting the tubes 26, 28 and fins 34 comprising the core 18.

The header channel 40 comprises a generally U-shaped stamped channel having interior 42 and exterior 44 surfaces. The channel 40 fits over the tube bends 22 with the front and rear arms 46 of the U-shaped stamped channel 40 extending over the sides of core 18. A plurality of apertures 48 are formed in each of the arms 46, each aperture 48 aligned with the apertures 48 of the other arm 46 across the channel 40. The apertures 48 are positioned to receive fasteners 49 between each of the straight tubes 20 for securing the channels 40 thereon.

In accordance with the present invention, each of the header channels 40 is formed of stamped steel. The channel 40 is hot dip galvanized to form a protective zinc alloy coating 47 on the steel. Thereafter, only the exterior side 44 of the channel 40 is optionally painted with a coating 51 of epoxy paint. The interior side 42 of the channel 40 which contacts the tube bends 22 remains as a bare zinc alloy coating 47*a*. The zinc alloy coating 47*a* on header channel 40 is sacrificially corroded to protect the tube bends 22 so as to prolong the life of the core 18. A suitable zinc alloy is of the type Galfan distributed by Weirton.

The thickness of coats 47, 47*a* and 51 are exaggerated in FIG. 3 in order to show the extent of protection afforded by the present invention. In one working embodiment, the thickness of zinc alloy coating 47 is 9 microns and the thickness of paint coating 51 is consistent with industry standards for painted brackets. However, the thickness maybe varied, preferably to a greater amount.

A mounting bracket 50 is secured to the header channel 40 for mounting the heat exchanger 10 to a vehicle and for supporting the inlet port 12. The header channel 40 simplifies the connection of the mounting bracket 50 to the heat exchanger 10. The mounting bracket 50 is generally U-shaped and includes two pairs of aligned bracket apertures 52 aligned across the cavity for securing about and to the channel 40. Fasteners 54 are inserted through the bracket apertures 52 and aligned header apertures 48 for ease of connection to standard vehicle framework.

The invention also includes a method of making a heat exchanger of the type for directing air through a core thereof for heat transfer with fluid flowing within the core. The method includes the steps of forming a serpentine path between an inlet and an outlet with a tube including straight passes extending across a core with bends at the ends thereof; placing a header channel adjacent and contacting the ends of the passes at the bends; and coating the interior surface of the channel which contacts the bends with zinc alloy such that the zinc alloy will sacrificially corrode to protect the bends.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims the invention may be practiced otherwise than as specifically described.

The embodiments of the invention in which an exclusive property or privilege is claimed are defined as follows:

1. A heat exchanger apparatus of the type for directing fluid through a core thereof for heat transfer with air flowing across the core, said apparatus comprising:

an inlet and an outlet;

a flow passage following a serpentine path having a plurality of passes across the core between tube bends at the ends of each pass lying in a single plane, said flow passage connecting said inlet to said outlet for communicating fluid therebetween;

a header channel extending over and contacting the bends at the ends of said passes for supporting said passage;

said header channel comprising an interior surface coated with a layer of sacrificial corrosion material in contact with said bends for allowing corrosion thereof while prolonging corrosion of said bend.

2. A heat exchanger apparatus of the type for directing fluid through a core thereof for heat transfer with air flowing across the core, said apparatus comprising:

an inlet and an outlet;

a flow passage following a serpentine path having a plurality of passes across the core between tube bends at the ends of each pass lying in a single plane, said flow passage connecting said inlet to said outlet for communicating fluid therebetween;

a header channel extending over and contacting the bends at the ends of said passes for supporting said passage;

said header channel comprising an interior surface coated with a layer of sacrificial corrosion material in contact with said bends for allowing corrosion thereof while prolonging corrosion of said bend, and having an exterior surface coated with a layer of sacrificial corrosion material and a covering layer of paint.

3. A heat exchanger apparatus of the type for directing fluid through a core thereof for heat transfer with air flowing cross the core, said apparatus comprising:

an inlet and an outlet;

a flow tube following a serpentine path having a plurality of passes across the core between tube bends at the ends of each pass and lying in a single plane connecting said inlet to said outlet for communicating fluid therebetween;

a header channel extending over and contacting the tube bends at the ends of said passes for supporting said tube;

said header channel comprising an interior surface coated with zinc alloy in contact with said tube bends for allowing sacrificial corrosion of said header channel while prolonging corrosion of said tube bend.

4. A heat exchanger apparatus of the type for directing fluid through a core thereof for heat transfer with air flowing across the core, said apparatus comprising:

an inlet and an outlet;

a flow tube following a serpentine path having a plurality of passes across the core between tube bends at the ends of each pass and lying in a single plane connecting said inlet to said outlet for communicating fluid therebetween;

a header channel extending over and contacting the tube bends at the ends of said passes for supporting said tube;

said header channel comprising an interior surface coated with zinc alloy in contact with said tube bends for allowing sacrificial corrosion of said header channel while prolonging corrosion of said tube bend, and having an exterior surface coated with a layer of sacrificial corrosion material and a covering layer of paint.

5. A method of making a heat exchanger of the type for directing fluid through a core thereof for heat transfer with air flowing across the core, the method including the steps of:

forming a serpentine path between an inlet and an outlet with a tube including straight passes extending across a core with bends at the ends thereof;

providing a header channel;

coating the interior surface of the channel with a zinc alloy layer; and placing the header channel adjacent to the bends so as to contact the zinc alloy layer and the bends whereby the zinc alloy layer will sacrificially corrode to protect the bends.

* * * * *